US009372447B2

(12) United States Patent
Ujiie et al.

(10) Patent No.: US 9,372,447 B2
(45) Date of Patent: Jun. 21, 2016

(54) CLEANER FOR ROTARY FIXING MEMBER, IMAGE FORMING APPARATUS INCORPORATING THE CLEANER, AND IMAGE FORMING METHOD EXECUTED BY THE IMAGE FORMING APPARATUS

(71) Applicants: Masateru Ujiie, Kanagawa (JP); Naoto Suzuki, Kanagawa (JP); Yohhei Watanabe, Kanagawa (JP); Takashi Sakamaki, Kanagawa (JP)

(72) Inventors: Masateru Ujiie, Kanagawa (JP); Naoto Suzuki, Kanagawa (JP); Yohhei Watanabe, Kanagawa (JP); Takashi Sakamaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/885,334

(22) Filed: Oct. 16, 2015

(65) Prior Publication Data

US 2016/0124357 A1 May 5, 2016

(30) Foreign Application Priority Data

Oct. 31, 2014 (JP) ..... 2014-222816

(51) Int. Cl.
*G03G 15/20* (2006.01)

(52) U.S. Cl.
CPC ..... *G03G 15/2025* (2013.01)

(58) Field of Classification Search
USPC ..... 399/71, 122, 320; 15/256.5, 256.51
See application file for complete search history.

(56) References Cited

U.S. PATENT DOCUMENTS

| | | | | |
|---|---|---|---|---|
| 5,848,341 | A * | 12/1998 | Watanabe | G03G 15/2025 15/256.5 |
| 5,970,298 | A * | 10/1999 | Seki | G03G 15/2025 399/326 |
| 6,771,925 | B2 * | 8/2004 | Satoh | G03G 15/2025 399/327 |
| 7,783,239 | B2 * | 8/2010 | Yamanaka | G03G 15/2025 399/320 |
| 2003/0002894 | A1 | 1/2003 | Satoh | |
| 2010/0316397 | A1 | 12/2010 | Kudou et al. | |
| 2011/0222923 | A1 | 9/2011 | Watanabe | |
| 2014/0212188 | A1 | 7/2014 | Watanabe | |
| 2014/0294456 | A1 | 10/2014 | Ueno et al. | |

FOREIGN PATENT DOCUMENTS

| | | |
|---|---|---|
| JP | 5-107950 | 4/1993 |
| JP | 2003-054798 | 2/2003 |

(Continued)

*Primary Examiner* — Hoan Tran
(74) *Attorney, Agent, or Firm* — Harness, Dickey & Pierce, P.L.C.

(57) ABSTRACT

An image forming apparatus includes a rotary fixing member cleaner that includes a freely rotatable rotary unwinding member, around which a cleaning web winds, a rotary winding member to wind the cleaning web thereon from one end thereof, and a load applicator to apply a load to the cleaning web unwound from the rotary unwinding member. The rotary fixing member cleaner removes any unnecessary substance adhering to an outer circumferential surface of the rotary fixing member therefrom by unwinding and moving the cleaning web from the rotary unwinding member in an opposite direction to a direction of movement of the outer circumferential surface of the rotary fixing member at a contacting point at which the cleaning web contacts the outer circumferential surface of the rotary fixing member. The load applicator presses against the cleaning web winding around the rotary unwinding member at a prescribed angular contact position.

19 Claims, 5 Drawing Sheets

(56) References Cited

FOREIGN PATENT DOCUMENTS

| | | |
|---|---|---|
| JP | 2011-191452 | 9/2011 |
| JP | 2014-134656 | 7/2014 |
| JP | 2014-149344 | 8/2014 |
| JP | 2014-191333 | 10/2014 |
| JP | 2014-228631 | 12/2014 |

* cited by examiner

CLEANER FOR ROTARY FIXING MEMBER, IMAGE FORMING APPARATUS INCORPORATING THE CLEANER, AND IMAGE FORMING METHOD EXECUTED BY THE IMAGE FORMING APPARATUS

CROSS-REFERENCE TO RELATED APPLICATION

This patent application is based on and claims priority pursuant to 35 U.S.C. §119(a) to Japanese Patent Application No. 2014-222816, filed on Oct. 31, 2014, in the Japan Patent Office, the entire disclosure of which is hereby incorporated by reference herein.

BACKGROUND

1. Technical Field

Embodiments of this invention relate to a rotary fixing member cleaner that employs a cleaning web to clean a rotary fixing member and an image forming apparatus with the rotary fixing member cleaner. Embodiments of this invention also relate to a method of forming an image by using the image forming apparatus employing the rotary fixing member cleaner.

2. Related Art

An image forming apparatus having a fixing roller and a cleaner with a cleaning web that cleans an outer circumferential surface of the fixing roller is known. In the known cleaner, a cleaning web winding around a rotary unwinding member is contacted against an outer circumferential surface of the fixing roller when a rotary winding member rotates and accordingly unwinds the cleaning web therefrom from one end thereof. To prevent the unwound cleaning web from loosely winding around the rotary winding member, the known cleaner employs an elastic member that presses against a rotary shaft of the rotary unwinding member to apply a rotational load thereto.

SUMMARY

Accordingly, one aspect of the present invention provides a novel image forming apparatus that includes a toner image forming device to form multiple toner images on a recording medium by using multiple toner particles respectively having different optimum fixing conditions; a fixing device having a rotary fixing member and a pressing member to fix the toner image formed by the toner image forming device into the recording medium based on a given fixing condition while holding the recording medium bearing the toner image thereon between the rotary fixing member and the pressing member; and a rotary fixing member cleaner. The rotary fixing member cleaner includes a freely rotatable rotary unwinding member, around which a cleaning web winds, a rotary winding member that winds the cleaning web unwound from the freely rotatable rotary unwinding member thereon from one end thereof, and a load applicator that applies a load to the cleaning web unwound from the rotary unwinding member. The rotary fixing member cleaner removes any unnecessary substance adhering to an outer circumferential surface of the rotary fixing member therefrom by unwinding and moving the cleaning web from the rotary unwinding member in an opposite direction to a direction of movement of the outer circumferential surface of the rotary fixing member at a contacting point at which the cleaning web contacts the outer circumferential surface of the rotary fixing member. The load applicator applies the load to the cleaning web by pressing against the cleaning web winding around the rotary unwinding member at a prescribed angular contact position, up to which the cleaning web winds around the rotary unwinding member at a prescribed angle from an unwinding angular position at which the cleaning web is unwound from the rotary unwinding member.

Another aspect of the present invention provides a novel rotary fixing member cleaner that includes: a freely rotatable rotary unwinding member, around which a cleaning web winds; a rotary winding member that winds the cleaning web unwound from the freely rotatable rotary unwinding member thereon from one end of the cleaning web; a drive motor that drives and rotates the rotary winding member to wind the cleaning web thereon, a cleaning web pressing roller biased by a biasing member to press the cleaning web stretched between the rotary winding member and the freely rotatable rotary unwinding member therebetween against an outer circumferential surface of the rotary fixing member; and a load applicator that applies a load to the cleaning web unwound from the rotary unwinding member. The rotary winding member rotates the freely rotatable rotary unwinding member by winding the cleaning web thereon while unwinding the cleaning web from the freely rotatable rotary unwinding member when driven and rotated. The rotary fixing member cleaner removes any unnecessary substance adhering to an outer circumferential surface of the rotary fixing member therefrom by unwinding and moving the cleaning web from the rotary unwinding member in an opposite direction to a direction of movement of the outer circumferential surface of the rotary fixing member at a contacting point at which the cleaning web contacts the outer circumferential surface of the rotary fixing member. The load applicator applies the load to the cleaning web by pressing against the cleaning web winding around the rotary unwinding member at a prescribed angular contact position, up to which the cleaning web winds around the rotary unwinding member at a prescribed angle from an unwinding angular position at which the cleaning web is unwound from the rotary unwinding member.

Yet another aspect of the present invention provides a novel method of forming an image that comprises the steps of: forming a toner image on a recording medium by using a toner image forming device with multiple toner particles respectively having different optimum fixing conditions; fixing the toner image formed by the toner image forming device into the recording medium based on a given fixing condition by using a fixing device having a rotary fixing member and a pressing member while holding the recording medium bearing the toner image thereon between the rotary fixing member and the pressing member; and cleaning an outer circumferential surface of the rotary fixing member by using a rotary fixing member cleaner including a freely rotatable rotary unwinding member, around which a cleaning web winds, a rotary winding member that rotates and winds the cleaning web unwound from the freely rotatable rotary unwinding member thereon from one end thereof, and a load applicator that applies a load to the cleaning web unwound from the rotary unwinding member. The step of cleaning the outer circumferential surface of the rotary fixing member includes the sub-steps of: applying the load to the cleaning web by pressing the load applicator against the cleaning web winding around the rotary unwinding member at a prescribed angular contact position, up to which the cleaning web winds around the rotary unwinding member at a prescribed angle from an unwinding angular position at which the cleaning web is unwound from the freely rotatable rotary unwinding member; unwinding and moving the cleaning web from a rotary unwinding member in an opposite direction to a direction of movement of the outer circumferential surface of the rotary fixing member at a contacting point at which the cleaning web contacts the outer circumferential surface of the rotary fixing member, and removing any unnecessary substance adhering to an outer circumferential surface of the rotary fixing member therefrom.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
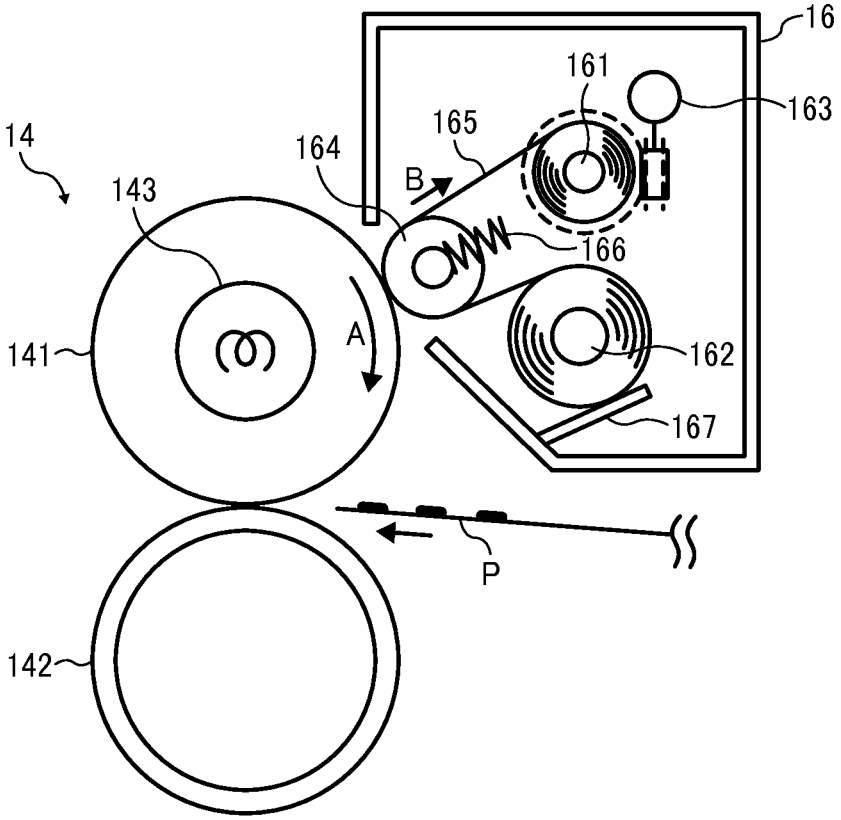
FIG. 1 is a diagram specifically illustrating an exemplary fixing unit included in an image forming apparatus according to one embodiment of the present invention.

In the above-described known image forming apparatus that includes a fixing roller and a cleaner with a cleaning web to clean an outer circumferential surface of the fixing roller by wiping thereof, since toner or the like adheres to an outer circumferential surface of the fixing roller, a friction already caused in a contact section between the fixing roller and the cleaning web rapidly grows sometimes. When the cleaning web loosely winds around the rotary winding member, the rotary winding member idles and cannot smoothly wind the cleaning web therearound anymore. Consequently, the cleaning web remains at the contact section between the fixing roller and the cleaning web, and the toner borne on the outer circumferential surface of the fixing roller is not wiped away, or the toner once wiped off therefrom may undesirably adhere to the outer circumferential surface of the fixing roller again. According to the known cleaner, since the elastic member presses against a shaft of the rotary unwinding member to apply a rotational load thereto, the cleaning web tightly winds around the rotary winding member thereby possibly suppressing such a problem sometimes.

However, in the image forming apparatus with the above-described cleaner, due to pressing of the elastic member against the shaft of the rotary unwinding member and applying the rotational load thereto, various challenges may occur as descried below.

First, in addition to Y (yellow), C (cyan), M (magenta), and K (black) toner particles, special color toner, such as transparent toner, white toner, etc., is increasingly utilized as well to form a color image in an image forming apparatus. However, shape and material of such special color toner is usually different from those of commonly used toner that forms an ordinary image, and accordingly, an optimum fixing condition (e.g., a fixing temperature and/or a fixing pressure or the like) is frequently different from that for the commonly used toner.

For example, a polymerized toner prepared by using a polymerization method to form a toner image has a prescribed optimum fixing condition under, which a toner image is fixed finest, different from that for a grinded toner prepared by using a grinding method to be used as the special color toner.

Hence, when the ordinary image forming toner and the special color toner respectively are borne on the same recording medium while having different optimum fixing conditions, it is difficult to set a fixing condition suitable for both of these toner particles. As a result, at least one of the toner particles cannot undergo a fixing process under the optimum fixing condition.

In such a situation, since toner incapable of receiving the fixing process under the optimum fixing condition is easily offset onto the outer circumferential surface of the fixing roller, the toner is increasingly offset onto the outer circumferential surface of the fixing roller. As a result, a large amount of toner adheres to the outer circumferential surface of the fixing roller, thereby increasing the friction between the fixing roller and the cleaning web.

To enhance cleaning performance of the cleaning web, a direction of movement of the cleaning web is generally set opposite to a direction of movement of the outer circumferential surface of the fixing roller at the contact section between the cleaning web and the fixing roller. However, a rotational driving force of the rotary winding member that winds the cleaning web thereon is generally weaker than that of the fixing roller, a large amount of toner adheres again onto the outer circumferential surface of the fixing roller, the friction between the fixing roller and the cleaning web further increases. Consequently, the cleaning web is highly likely driven and moved reversely by the fixing roller, and is undesirably drawn out therefrom. As a result, normal cleaning operation is no longer expected.

The above-described problem occurs not only when the toner image formed by using both the special color toner and the ordinary toner for the ordinary image is fixed in the fixing process, but also when a toner image created by using multiple toner particles having different optimum fixing conditions, respectively, is fixed.

Figure 2:
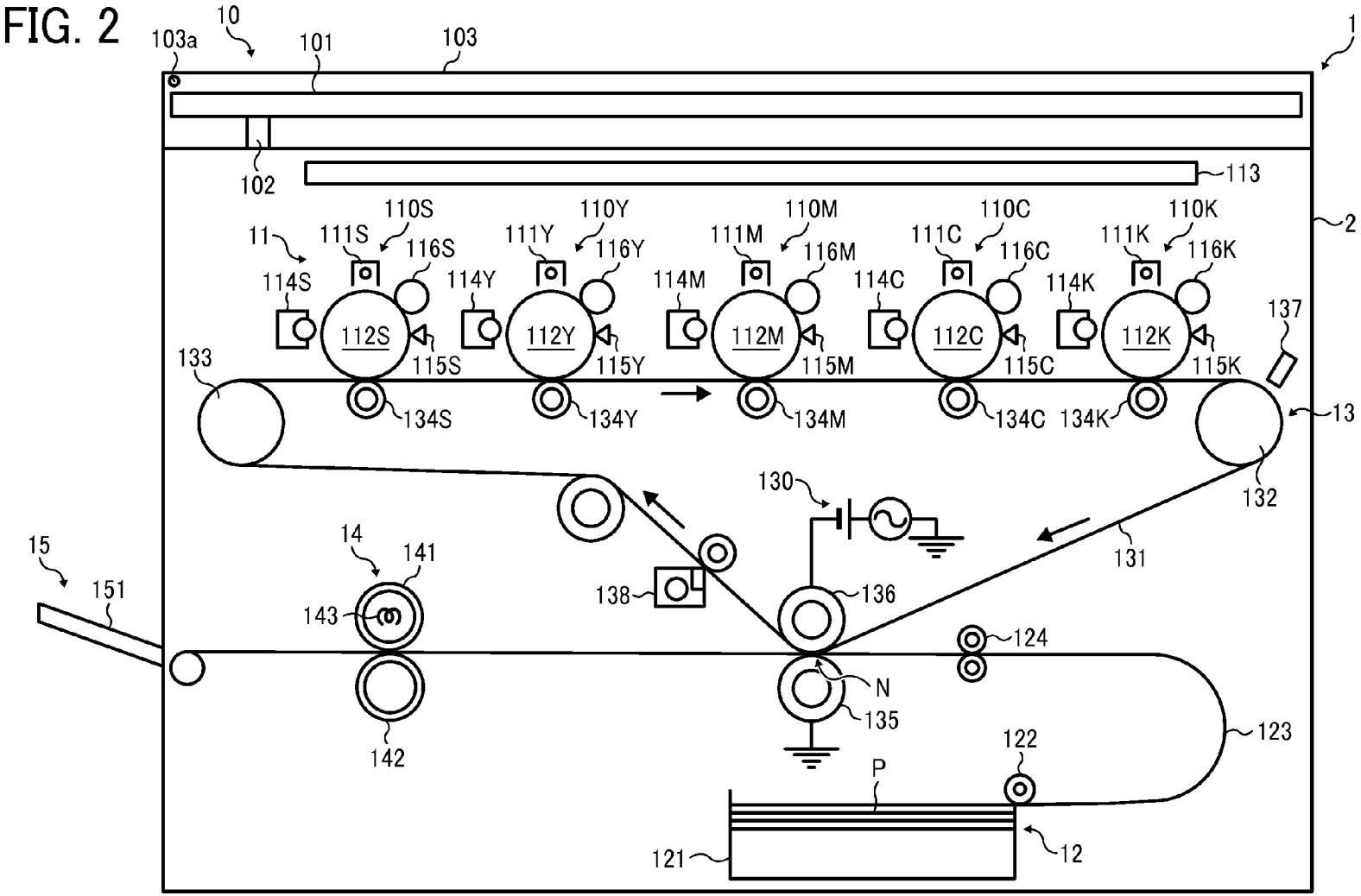
FIG. 2 is a diagram schematically illustrating an exemplary configuration of the image forming apparatus including the fixing unit of FIG. 1.

Referring now to the drawings, wherein like reference numerals designate identical or corresponding parts throughout the several views thereof, and in particular to FIG. 2, an exemplary configuration of an image forming apparatus according to one embodiment of the present invention is herein below descried in detail. The image forming apparatus 1 shown in FIG. 2 is a color image forming apparatus that employs a tandem type image forming section (hereinafter simply referred to as an image forming section) to form a color image. The image forming apparatus 1 is configured by an image reading unit 10, an image forming section 11, a sheet feeding unit 12, a transfer unit 13 as a transfer device, a fixing unit 14 as a fixing device, and a sheet ejection unit 15. In this embodiment of the present invention, a toner image forming device is mainly configured by the image forming section 11 and the transfer unit 13 to form a toner image on a recording medium.

The image reading unit 10 is mainly composed of a contact glass 101, a reading sensor 102, an openable cover 103, and a light source or the like to read an image of a manuscript as an image reading objective and generates image information. Onto the contact glass 101, the manuscript is placed by an operator. The reading sensor 102 reads information of the image of the manuscript mounted on the contact glass 101 by receiving light emitted from the light source and reflected by the manuscript thereafter. The openable cover 103 is enabled to swing around a rotary shaft 103*a* thereof to be opened and closed.

In the image reading unit 10, a light beam is emitted from the light source to the manuscript placed on the contact glass 101 by pivoting the openable cover 103. The reading sensor 102 is configured by a CCD (Charge Coupled Device) and a CIS (Contact type Image Sensor) or the like and receives light reflected by the manuscript, and reads electrical color resolution signals of RGB (Red, Green, and Blue) of three primary colors of the light.

The image forming section 11 includes five image forming units 110S, 110Y, 110M, 110C, and 110K, which form and output a toner image of a special color S, such as colorless, transparency (i.e., a clear color), a white color, etc., in addition to toner images of four colors of yellow (Y), magenta (M), cyan (C), and black (K) as well.

In this embodiment of the present invention, prescribed toner having a volume average particle size of from about 5 μm to about 10 μm can be employed. For example, from about 60% to about 80% (a percentage of article number) of the toner may have the particle size of about 5 [μm]. The toner of this embodiment of the present invention is mainly made of resin and colorant, and can additionally include wax or inorganic fine particles as well. Here, a toner preparation method is not particularly limited to one. For example, one of a grinding method and a polymerization method can be optionally employed. However, four color toner particles of Y, M, C, and K are prepared only by using the polymerization method, and the toner of the special color S is prepared only by using the grinding method to the contrary in this embodiment of the present invention.

As a resin component, any one of conventional resins can be employed as descried below. For example, styrene resin (single polymer or copolymer with styrene or styrenic derivative substitution), such as styrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymer, styrene-methacrylic acid ester copolymer, styrene-α-chloracrylic acid methyl copolymer, styrene-acrylonitrile-acrylic acid ester copolymer etc., can be employed. Also possibly employed as the resin component is polyester resin, epoxy resin, polyvinyl chloride resin, rosin modified maleic acid resin, phenolic resin, polyethylene resin, polyester resin, polypropylene resin, petroleum resin, polyurethane resin, ketone resin, ethylene-ethyl acrylate copolymer, xylene resin, or polyvinyl butyrate resin and the like. Although one of the above-described resins can be used alone, two types thereof can be also used at the same time.

As a colorant, although known material, such as carbon black, lamp black, iron black, ultramarine, nigrosine dye, aniline blue, calco oil blue, black oil, azo oil black, etc., is used, it is not especially limited thereto. As a wax component, known wax, such as carnauba wax, rice wax, and synthetic ester wax or the like can be used. However, it is not especially limited thereto again. As an inorganic fine particle, known material, such as silica fine powder and titanium oxide fine powder or the like can be used.

Although the five image forming units 110S, 110Y, 110M, 110C, and 110K employ toner particles as image forming materials respectively having different colors S, Y, M, C, and K, the five image forming units 110S, 110Y, 110M, 110C, and 110K are otherwise similarly configured. Thus, the five image forming units 110S, 110Y, 110M, 110C, and 110K are replaced at the ends of their lives. Each of the image forming units 110S, 110Y, 110M, 110C, and 110K is configured to be attachably detachable as a so-called process cartridge to and from a body of an image forming apparatus. A common configuration is herein below typically descried only with reference to the image forming unit 110K that forms a K toner image.

The image forming unit 110K includes an electric charging device 111K, a photoconductive drum 112K acting as a latent image bearer, a developing device 114K, an electric charge removing device 115K, and a photoconductive drum cleaner 116K or the like. These devices are commonly held by a holder and are replaced with new ones by integrally removing those from the body of the image forming apparatus at the same time.

The photoconductive drum 112K has a drum shape having a diameter of about 60 mm and is configured by a base material and an organic photoconductive layer that overlies a surface of the base material. The photoconductive drum 112K is driven counterclockwise in FIG. 2 by a driving device. The electric charging unit 111K uniformly charges a surface of the photoconductive drum 112K by applying a charging bias to an electric charging wire included in an electric charger (i.e., an electric charging member) to act as a charging electrode. The electric charging unit 111K accordingly generates electric discharge between an outer circumferential surface of the photoconductive drum 112K and the electric charging wire.

In this embodiment of the present invention, the outer circumferential surface of the photoconductive drum 112K is electrically charged to have a negative polarity as the toner (i.e., a charged polarity of the toner). The electric charging bias is obtained by superimposing an AC (Alternating Current) voltage with a DC (Direct Current) voltage and is adopted here. Instead of the electric charger, an electric charge roller may be alternatively adopted by bringing it either in contact with or close to the photoconductive drum 112K as well.

A uniformly charged outer circumferential surface of the photoconductive drum 112K receives scanning of laser light emitted from an exposing unit 113, thereby forming a K-color electrostatic latent image thereon. A potential of a portion irradiated with the laser beam decreases as different from a remaining portion in the entire outer circumferential surface of the uniformly charged photoconductive drum 112K, thereby forming an electrostatic latent image thereon, in which a potential of the laser irradiated portion is smaller than potentials of the other remaining areas (i.e., a background).

The electrostatic latent image for K-color is then rendered visible (i.e., developed) by a developing device 114K storing K-color toner to be a K-color toner image as descried later in detail. Subsequently, the K-color toner image is primarily transferred onto an intermediate transfer belt 131 as also descried later in detail.

The developing device 114K includes a container to store two-component developer mainly composed of K toner and carrier or the like. Under influence of magnetic force of a magnetic roller accommodated in a developing sleeve disposed in the container, the developing sleeve bears the developer on a surface thereof. Onto the developing sleeve, a prescribed developing bias is applied. That is, the developing bias has the same polarity as the toner and is greater than a voltage of the electrostatic latent image borne the photoconductive drum 112K, which is smaller than a charged potential of the photoconductive drum 112K. Hence, a developing potential operates between the electrostatic latent image borne on the photoconductive drum 112K and the developing sleeve in a direction from the developing sleeve to the electrostatic latent image borne thereon. Between the developing sleeve and the background of the photoconductive drum 112K, a non-developing potential also operates at the same time to move toner borne on the developing sleeve toward the surface of the developing sleeve. Subsequently, under the influences of the developing potential and the non-developing potential as well, the K toner bone on the developing sleeve selectively adheres to and accordingly partially visualizes the electrostatic latent image borne on the photoconductive drum 112K.

An electric charge removing device 115K removes electric charge remaining on the outer circumferential surface of the photoconductive drum 112K after the toner image is primarily transferred onto the intermediate transfer belt 131. A photoconductive drum cleaner 116K having both a cleaning blade and a cleaning brush is provided. The photoconductive drum cleaner 116K removes transfer residual toner or the like remaining on the outer circumferential surface of the photoconductive drum 112K after the electric charge is removed by the electric charge removing device 115K therefrom.

As shown in FIG. 2, respective S, Y, M, and C color toner images are formed on the photoconductive drums 112S, 112Y, 112M, and 112C in the remaining image forming units 110C, 110M, 110Y, and 110S as well as in the image forming unit 110K.

Above the multiple image forming units 110S, 110Y, 110M, 110C, and 110K, an exposing unit 113 is placed to act as one of latent image forming devices. The exposing unit 113 executes optical scanning by emitting laser beams from the laser diodes to the respective photoconductive drums 112S, 112Y, 112M, 112C, and 112K based on image information transmitted from the image reading unit 10 or an external device such as a personal computer, etc.

The exposing unit 113 emits laser light beams from the light sources to the photoconductive drums 112S, 112Y, 112M, 112C, and 112K through multiple optical lenses and mirrors, while driving a polygon motor and horizontally polarizing the laser light beams emitted with a polygon mirror in a main scanning direction. However, instead of the laser light, LED (Light Emitting Diode) light can be employed and emitted from multiple LEDs to execute an optical writing process as well.

A sheet feeding unit 12 is provided to feed a sheet P as one example of a recording medium toward the transfer unit 13. The sheet feeding unit 12 includes a sheet containing unit 121, a sheet pickup feeding roller 122, a sheet conveyance path 123, and a pair of registration rollers 124.

To convey the sheet P housed in the sheet containing unit 121 toward the sheet conveyance path 123, the sheet pickup feeding roller 122 rotates. That it, the sheet pickup feeding roller 122 provided in this way takes the topmost sheet P out of the sheets P housed in the sheet containing unit 121 one piece at a time, and sends it toward the sheet conveyance path 123.

Hence, the sheet P is launched into the sheet conveyance path 123 by the sheet pickup feeding roller 122 and is further conveyed by a pair of conveying rollers toward the transfer unit 13. At that time, the pair of registration rollers 124 disposed on the way to the transfer unit 13 sandwiches a tip of the sheet P therebetween to temporarily stop transportation of the sheet P. The pair of registration rollers 124 timely feeds the sheet P toward a secondary transfer nip N acting as a transfer nip N of the transfer unit 13 to synchronize with the toner image borne on the intermediate transfer belt 131 at the secondary transfer nip N.

The transfer unit 13 is positioned below the multiple image forming units 110S, 110Y, 110M, 110C, and 110K. The transfer unit 13 has a driving roller 132, a driven roller 133, an intermediate transfer belt 131, a primary transfer roller 134, a secondary transfer roller 135, a secondary transfer counter roller 136, a toner adhering amount detector 137, and a belt cleaner 138 or the like.

The intermediate transfer belt 131 acts as an intermediate transfer member mainly composed of an endless belt. The intermediate transfer belt 131 is stretched and suspended by the driving roller 132, the driven roller 133, the secondary transfer counter roller 136, and the multiple primary transfer rollers 134S, 134Y, 134M, 134C, and 134K, arranged inside a loop of the intermediate transfer belt 131 or the like. Here, the term arrangement represents either disposition or positioning. The term stretch and suspension also means winding of a belt under a prescribe amount of tension.

The intermediate transfer belt 131 is rotated and moved clockwise in the drawing by the driving roller 132 driven clockwise in the drawing by a driving device (e.g., a drive motor) while contacting the photoconductive drums 112S, 112Y, 112M, 112C, and 112K. A thickness of the intermediate transfer belt 131 is from about 20 [μm] to about 200 [μm], and is more desirably about 60 [μm]. A volume resistivity of the intermediate transfer belt 131 is from about $1\times10^{6}$ [Ω·cm] to about $1\times10^{12}$ [Ω·cm]. The intermediate transfer belt 131 is desirably made of carbon dispersed polyimide resin having the volume resistivity of about $1\times10^{9}$ [Ω·cm]. The resistivity is measured by using Hiresta UP MCP HT45 manufactured by Mitsubishi Chemical under application of a voltage 100 V thereto.

At a position opposed to the intermediate transfer belt 131 winding around the driving roller 132, a toner adhering amount detector 137 is positioned apart from a front surface of the intermediate transfer belt 131. The toner adhering amount detector 137 acts as a toner adhering amount detecting unit to detect an adhering amount of toner in the toner image of a special color S, such as colorless, transparency (i.e., a clear color), a white color, etc., transferred and borne on the intermediate transfer belt 131.

The toner adhering amount detector 137 is mainly composed of a reflective light photosensor. The toner adhering amount detector 137 measures the toner adhering amount of the toner image of the special color S by detecting an intensity of reflected light from the toner image of the special color S.

However, the toner adhering amount detector 137 is not necessarily employed, and a commonly used toner density sensor that detects toner density as a toner density detector can be also employed instead. In such a situation, as a provision of a new toner density detector is omitted, the number of parts can be deceased, thereby reducing the cost thereof. Here, the toner adhering amount detector 137 can be positioned at another location near one of the photoconductive drums 112K to 112S to detect the toner adhering amount of the toner image borne on the one of the photoconductive drums 112K to 112S as well.

The multiple primary transfer rollers 134S, 134Y, 134M, 134C, and 134K are opposed to the photoconductive drums 112S, 112Y, 112M, 112C, and 112K, respectively, across the intermediate transfer belt 131, and are driven and rotated to move the intermediate transfer belt 131. With this, the front surface of the intermediate transfer belt 131 and the photoconductive drum 112S, 112Y, 112M, 112C, and 112K collectively form multiple primary transfer nips N therebetween. Here, the term contact means contacting under pressure.

To each of the primary transfer rollers 134S, 134Y, 134M, 134C, and 134K, a primary transfer bias voltage is applied from a primary transfer bias power source. With this, between multiple toner images of S, Y, M, C, and K colors borne on the photoconductive drum 112S, 112Y, 112M, 112C, and 112K and the primary transfer rollers 134S, 134Y, 134M, 134C, and 134K, multiple primary transfer electric fields are formed, respectively. Hence, respective color toner images are transferred onto the intermediate transfer belt 131, sequentially, under influence of the respective primary transfer electric fields.

A toner image bearing toner of a special color S formed on the outer circumferential surface of the photoconductive drum 112S enters the primary transfer nip N for the special color S as the photoconductive drum 112S rotates. Subsequently, under influences of the transfer electric field and transfer pressure, the toner image bearing the toner of the special color S is primarily transferred from the photoconductive drum 112S onto the intermediate transfer belt 131.

In this way, the intermediate transfer belt 131, onto which the toner image bearing the toner of the special color S is primarily transferred, sequentially passes through the multiple primary transfer nips N of Y, M, C, and K colors one by one in this order. Subsequently, the color toner images of Y, M, C, and K colors borne on the respective photoconductive drums 112Y, 112M, 112C, and 112K, are primarily transferred and superimposed successively onto the toner image bearing the toner of the special color S one after another. As a result of the above-described primary transfer process of the superimposition of the toner images, a superimposed toner image including the color toner images and the toner image of the special color toner such as a colorless toner image, etc., is formed on the intermediate transfer belt 131 as well.

Each of the primary transfer rollers 134S, 134Y, 134M, 134C, and 134K can be mainly composed of an elastic roller constituted by a metal core and a conductive sponge layer overlying thereon. Each the primary transfer rollers 134S, 134Y, 134M, 134C, and 134K has an outer diameter of about 16 mm. A diameter of the metal core of each of the primary transfer rollers 134S, 134Y, 134M, 134C, and 134K is about 10 mm as well. Here, a resistance value R of the sponge layer is calculated based on an amount of current I flowing therethrough under a condition in that a voltage of 1000 V is applied to each of the metal cores of the respective primary transfer rollers 134S, 134Y, 134M, 134C, and 134K while a prescribed grounded metal roller having an outer diameter of about 30 mm is pressed against the sponge layer with force of about 10 N (newton). Specifically, the resistance value R of the sponge layer is calculated in accordance with Ohm's law (R=V/I) based on the current I flowing therethrough under the condition in that the voltage of 1000 V is applied to the above-descried metal core, and is obtained as about $3\times10^7$ [Ω]. To each of the multiple primary transfer rollers 134S, 134Y, 134M, 134C, and 134K, a primary transfer bias, outputted from a primary transfer bias power source is also applied under constant current control.

Instead of the multiple primary transfer rollers 134S, 134Y, 134M, 134C, and 134K, multiple primary transfer chargers or primary transfer brushes may be also adopted, respectively, as well.

The secondary transfer roller 135 and the secondary transfer counter roller 136 sandwich the intermediate transfer belt 131 therebetween. Accordingly, the front surface of the intermediate transfer belt 131 and the secondary transfer roller contact each other, thereby forming the secondary transfer nip N therebetween. The secondary transfer roller 135 is driven and rotated by a driving device and acts as a nip forming member and a transfer member at the same time as well as descried above. The secondary transfer counter roller 136 also acts as a nip forming member and a counter member as well as descried above. The secondary transfer roller 135 is electrically grounded. By contrast, a secondary transfer bias voltage is applied to the secondary transfer counter roller 136 from a secondary transfer bias power source 130.

Since it includes an AC (Alternating Current) power source and a DC (Direct Current) power source, the secondary transfer bias power source 130 can output a secondary transfer bias generated by superimposing the AC voltage on the DC voltage. Since an output terminal of the secondary transfer bias power source 130 is connected to the metal core of the secondary transfer counter roller 136, a potential of the metal core of the secondary transfer counter roller 136 is almost equivalent to a voltage value outputted from the secondary transfer bias power source 130.

Further, since the secondary transfer bias is applied to the secondary transfer counter roller 136, a secondary transfer electric field is formed between the secondary transfer counter roller 136 and the secondary transfer roller 135 to electrostatically move toner having a negative polarity from the secondary transfer counter roller 136 to the secondary transfer roller 135. Hence, the toner borne on the intermediate transfer belt 131 having the negative polarity is electrostatically moved from the secondary transfer counter roller 136 to the secondary transfer roller 135.

A DC component of the secondary transfer bias power source 130 has a negative polarity as the toner. A time average of the superimposed bias voltage is adjusted to have a negative polarity as the toner. The metal core of the secondary transfer counter roller 136 can be electrically grounded while applying the superimposed bias to the secondary transfer roller 135. In such a situation, the polarities of the DC voltage and the DC component are reversed.

When a sheet P having a large unevenness on a surface thereof, such as a sheet prepared by using an emboss process, etc., is used, the above-described superimposed bias is applied to reciprocate and relatively move between the toner borne the intermediate transfer belt 131 and the sheet P, so that the toner can be effectively transferred onto the sheet P. This improves transfer performance of the toner onto multiple recesses of the surface of the sheet P, thereby upgrading a transfer rate while reducing occurrence of an abnormal image such as dropout, etc. By contrast, when a sheet P having a small unevenness on the surface thereof, such as a plain paper, etc., is used, since a gray-scale pattern does not appear along an uneven pattern of the uneven surface of the sheet P, preferred transfer performance can be obtained even when a secondary transfer bias only having the DC component is applied thereto.

The secondary transfer roller 135 is constituted by a metal core made of stainless steel, aluminum, etc., and a resistive layer stacked thereon. An outer diameter of the secondary transfer roller 135 is approximately 24 mm. A diameter of the metal core is approximately 16 mm. The resistive layer of the secondary transfer roller 135 is made of material prepared by dispersing conductive particles, such as carbon, metal complex, etc., in one of fluorine rubber, silicon rubber, and polycarbonate or the like. Otherwise, the resistive layer may be made of one of NBR (Acrylonitrile-Butadiene Rubber)/ECO (Epichlorohydrin Rubber) copolymer rubber, NBR and EPDM rubber (Ethylene-Propylene-Diene rubber), and semiconductive rubber of polyurethane or the like. A volume resistance of the resistive layer is from about $10^6$ [Ω] to about $10^{12}$Ω, and is more desirably from about $10^7$ [Ω] to about $10^9$ [Ω].

The resistive layer of the secondary transfer roller 135 may be either a foam type having a rubber hardness (ASKER-C: a standard of Society of Rubber Industry, Japan) of from about 20 degrees to about 50 degrees or a rubber type having a hardness of from about 30 degrees to about 60 degrees. However, since the resistive layer of the secondary transfer roller 135 contacts the secondary transfer counter roller 136 via the intermediate transfer belt 131, a sponge type is desirable. Because, a non-contact section does not appear even when relatively smaller contact pressure is applied to the resistive layer of the secondary transfer roller 135. That is, the sponge type is desirable to readily avoid a problem in that the dropout appears in either a character or a line of an image even when relatively great contact pressure is applied between the intermediate transfer belt 131 and the secondary transfer roller 135.

Transfer residual toner not transferred onto the sheet P remains on the intermediate transfer belt 131 after the secondary transfer process is executed in the secondary transfer nip N. However, the transfer remaining toner is removed thereafter from the surface of the intermediate transfer belt 131 by a cleaner 138 having a cleaning blade that contacts the surface of the intermediate transfer belt 131.

The fixing unit 14 employs a roller type fixing system rotating clockwise as shown by arrow A in FIG. 1. The fixing unit 14 is constituted by a fixing roller 141 acting as a rotary fixing member that accommodates an internal heat source 143 and a pressing roller 142 of a pressing rotator acting as a pressing member. The fixing roller 141 and the pressing roller 142 contact each other across a sheet conveyance path for the sheet P. The fixing roller 141 and the pressing roller 142 apply heat and pressure, respectively, to an un-fixed toner image borne on the sheet P, thereby fixing the toner into the sheet P.

The sheet P sent into the fixing unit 14 is sandwiched by the fixing roller 141 and the pressing roller 142 in a fixing nip formed therebetween with its un-fixed toner image bearing side contacting the fixing roller 141. Subsequently, the toner image is fixed by the heat and the pressure into the sheet P as described above.

When an image is to be formed on another surface of the sheet P than the surface, onto which the toner image has been fixed, the sheet P having completed a fixing process of fixing the toner image in the fixing unit 14 is conveyed to a sheet inversion mechanism to reverse the sheet P therein. Subsequently, as similar to the above-described image formation process, the toner image is formed on the opposite side (i.e., another side) of the sheet P.

The sheet P with the toner fixed thereinto in the fixing unit 14 is discharged to an outside of a body 2 of the image forming apparatus 1 via a sheet ejecting roller constituting a sheet ejection unit 15, and is stacked on a sheet ejection tray 151.

As specifically illustrated in FIG. 1, the fixing roller 141 employed in an exemplary fixing unit 14 according to one embodiment of the present invention is a rotator made of good heat conductor member accommodating the internal heat source 143. The fixing roller 141 also includes a release layer made of material such as PTFE, etc., overlying an outer circumferential surface of the internal heat source 143. The pressing roller 142 includes an elastic layer made of elastic material such as silicone rubber, etc., overlying an outer circumferential surface of a metal core. Hence, when it is pressed against the fixing roller 141, the outer circumferential surface of the pressing roller 142 partially deforms to follow the outer circumferential surface of the fixing roller 141 thereby forming a fixing nip therebetween.

In the image forming apparatus 1 of this embodiment of the present invention, there is provided a web cleaning unit 16 as a fixing member cleaner to remove any unnecessary substance (e.g., offset toner or the like) adhering to the outer circumferential surface of the fixing roller 141. The web cleaning unit 16 includes a pair of rollers 161 and 162. The roller 161 acts as a rotary winding member that winds the cleaning web 165 thereon. That is, the roller 161 is driven and rotated by rotation driving force of a drive motor 163 to wind the cleaning web 165 thereon in a direction as shown by allow B in the drawing. The roller 162 acts as an unwinding roller as a rotary unwinding member to unwind the cleaning web 165 therefrom. The roller 162 is supported by a bearing shaft to freely rotate therearound. Both of longitudinal edges of the cleaning web 165 (i.e., both ends of the cleaning web 165 in a direction of movement of the cleaning web) are fixed to the winding roller 161 and the unwinding roller 162, respectively.

In the web cleaning unit 16, the winding roller 161 winds the cleaning web winding around the unwinding roller 162 thereon from one end thereof. At that time, the cleaning web 165 unwound from the unwinding roller 162 is brought in sliding contact with the outer circumferential surface of the fixing roller 141 to clean the outer circumferential surface thereof. In this embodiment of the present invention, in a contact area in which the respective outer circumferential surfaces of the cleaning web 165 and the fixing roller 141 contact each other, the cleaning web 165 is controlled to move in an opposite direction to a direction of movement of the outer circumferential surface of the fixing roller 141. With this, a relative speed of the outer circumferential surface of the cleaning web 165 to that of the fixing roller 141 increases therebetween, thereby effectively demonstrating high cleaning performance.

Also, in the web cleaning unit 16, a web pressing roller 164 acting as a web pressing member biased by a biasing unit 166 such as a spring, etc., is provided to partially press the cleaning web 165 stretched by the winding roller 161 and the unwinding roller 162 therebetween against the outer circumferential surface of the fixing roller 141. Hence, the cleaning web 165 is pressed against the outer circumferential surface of the fixing roller 141 under a desired level of pressure, thereby demonstrating good cleaning performance.

The cleaning web 165 may be constituted by a nonwoven fabric prepared, for example, by mixing fibers of aramid and polyethylene terephthalate (PET) with each other. The cleaning web 165 may be impregnated with release agent such as silicone oil, etc., optionally. In such a situation, since the outer circumferential surface of the fixing roller 141 is coated with the release agent, an unwanted object such as toner, etc., rarely adheres thereto.

In the web cleaning unit 16 of this embodiment of the present invention, an elastic blade 167 acting as a load applicator is also provided to apply a prescribed amount of load onto the cleaning web 165 unwound from the unwinding roller by pressing against the cleaning web 165 yet winding around the unwinding roller 162. A fixed end of the elastic blade 167 located upstream in a direction of rotation of the unwinding roller 162 (i.e., counterclockwise in the drawing) is fixed to a housing of the web cleaning unit 16. By contrast, a plate face near a free end of the elastic blade 167 located downstream in the direction of rotation of the unwinding roller 162 contacts the cleaning web 165 yet winding around the unwinding roller 162 via a prescribed area as shown in FIG. 1. Since the plate face near the free end of the elastic blade 167 contacts the cleaning web 165 yet winding around the unwinding roller 162 with its fixed end secured to the housing, the elastic blade 167 deflects in a prescribed direction. Since such deflection of the elastic blade 167 accordingly causes resilience thereof, desired friction force can be generated between the cleaning web 165 winding around the unwinding roller 162 and the elastic blade 167. With this, a prescribed load (i.e., an unwinding load) is applied onto the cleaning web 165 to be unwound from the unwinding roller 162.

Alternatively, to apply the unwinding load to the cleaning web 165, an elastic member can contact a shaft of the unwinding roller 162, for example. In such a system, a load receiving position is closer to a rotational center of the unwinding roller 162 than that in the above-described system, in which the cleaning web 165 winding around the unwinding roller 162 is pressed by the elastic member. For this reason, in the latter system, a heavy rotational load, and accordingly intensive unwinding load are rarely applied to the unwinding roller 162 and the cleaning web 165, respectively, when it is unwound from the unwinding roller 162. Hence, to apply a greater unwinding load to the cleaning web 165, it is preferred that the cleaning web 165 winding around the unwinding roller 162 is pressed as in this embodiment of the present invention.

Further, when the unwinding load is applied to the cleaning web 165 winding around the unwinding roller 162, an edge of the elastic blade 167 can be contacted and pressed against the cleaning web 165 as one of load applying systems. With this system, since great pressure is readily obtained, an intensive unwinding load can be easily applied to the cleaning web 165. As a result, the edge of the elastic blade 167 may disadvantageously damage the cleaning web 165 easily. By contrast, however, according to this embodiment of the present invention, since the plate face of the elastic blade 167 contacts and presses against the cleaning web 165 via the contact area, the cleaning web 165 is advantageously rarely damaged.

Figure 3:
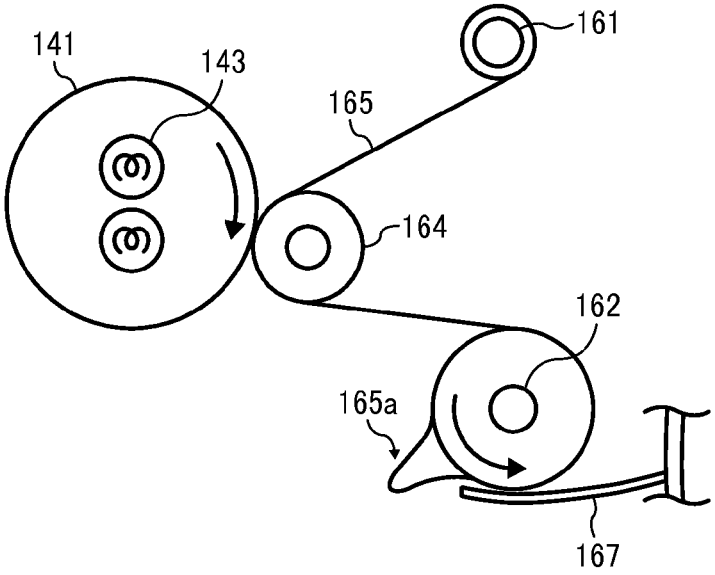
FIG. 3 is a diagram illustrating an aspect when a cleaning web is partially relaxed upstream of the elastic blade in a direction of rotation of an unwinding roller and is then hooked by an edge of the elastic blade according to one embodiment of the present invention.

However, even in the above-described system, in which the cleaning web 165 is pressed by the plate face of the elastic blade 167 via the contact area, when the free end of the elastic blade 167 is located upstream in the direction of rotation of the unwinding roller 162 as shown in FIG. 3, the below descried various problems may occur. For example, when it is wound around the unwinding roller 162, the cleaning web 165 loosely winds therearound sometimes. In such a situation, when the cleaning web 165 is unwound from the unwinding roller 162 while contacted by the elastic blade 167 as the winding roller 161 rotates and winds the cleaning web 165, the cleaning web 165 is loosened upstream of the contact area of the elastic blade 167 in the direction of rotation of the unwinding roller 162 as shown in FIG. 3. At this moment, since the free end of the elastic blade 167 is located upstream in the direction of rotation of the unwinding roller 162 as shown in FIG. 3, a loosened portion 165*a* formed upstream of the contact area of the elastic blade 167 is caught by the free end (i.e., the edge) of the elastic blade 167, and accordingly either the cleaning web 165 cannot be unwound or a similar event disadvantageously occurs.

Figure 4:
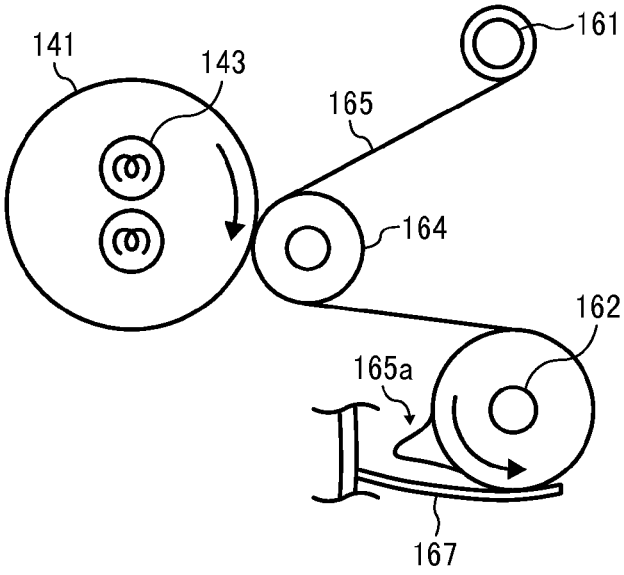
FIG. 4 is a diagram illustrating an aspect when the cleaning web is partially relaxed upstream of the elastic blade in the direction of rotation of an unwinding roller and is not hooked by the edge of the elastic blade according to one embodiment of the present invention.

Hence, according to this the embodiment of the present invention, the free end of the elastic blade 167 is positioned downstream in the direction of rotation of the unwinding roller 162. With this configuration, even when the cleaning web 165 relaxes upstream of the contact section of the elastic blade 167 in the direction of rotation of the unwinding roller 162, the loosened portion 165*a* can avoid from being hooked to the elastic blade 167 as shown in FIG. 4.

Here, even though the free end of the elastic blade 167 is positioned upstream in the direction of rotation of the unwinding roller 162 as shown in FIG. 3, when an elastic blade 167 having a free end subjected to a hemming bending process is utilized in such a system, the loosened portion 165*a* can similarly avoid from being hooked to the elastic blade 167 again.

Figure 5:
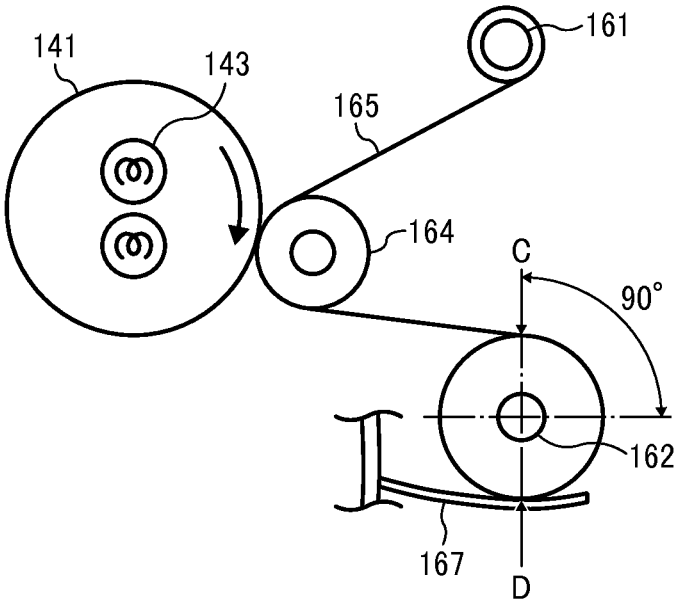
FIG. 5 is a diagram illustrating an exemplary angular contact position on the unwinding roller contacted by the elastic blade according to one embodiment of the present invention.

Further, as shown in FIG. 5, according to this embodiment of the present invention, to apply a greater unwind load to the cleaning web 165, the elastic blade 167 contacts the unwinding roller 162 at an angular contact position D, up to which the cleaning web winds therearound at a prescribed angle or more from an angular unwinding position C, from which the cleaning web 165 is unwound from the unwinding roller 162. The above-described prescribed angle is appropriately determined and set in accordance with material of the cleaning web 165, that of the elastic blade 167, and pressure of the elastic blade 167 or the like.

Figure 6:
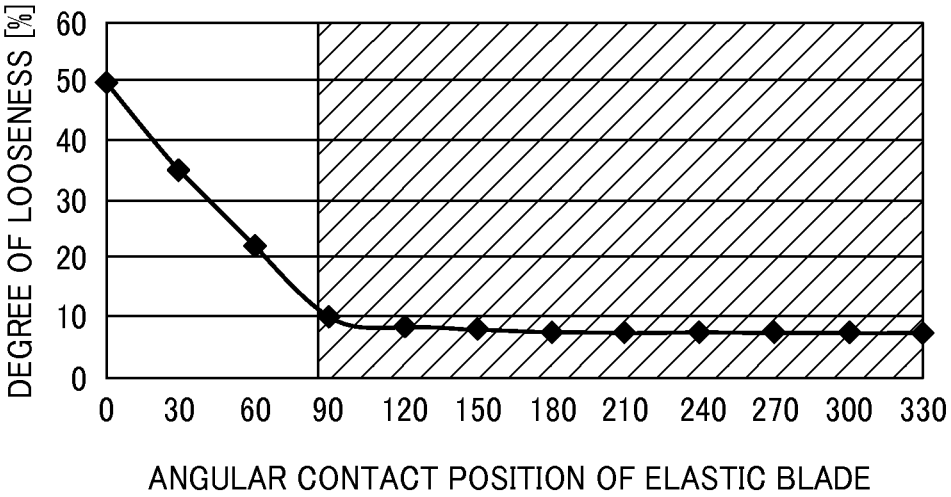
FIG. 6 is a chart illustrating an exemplary relation between the angular contact position on the unwinding roller contacted by the elastic blade and a degree of looseness of the cleaning web according to one embodiment of the present invention.

FIG. 6 is a graph illustrating an exemplary relation between a degree of looseness of the cleaning web 165 and an angular contact position of the elastic blade 167. The angular contact position of the elastic blade 167 is defined by an angle created by a radial line passing through the angular unwinding position C, from which the cleaning web is unwound from the unwinding roller 162, and that passing through a point on the cleaning web contacted by the elastic blade 167. Here, the degree of looseness of the cleaning web 165 may be represented by a ratio of an actual length of the cleaning web 165 existing between the winding roller 161 and the unwinding roller 162 to a shortest movement length of the cleaning web 165 from the unwinding roller 162 to the winding roller 161 (i.e., an ideal length of the cleaning web 165 excluding a loosened portion (i.e., a relaxed portion) therein between the unwinding roller 162 and the winding roller 161).

In one example, as shown in FIG. 6, as an angle of the angular contact position D of the elastic blade 167 is increased from an angle of about 0°, the degree of looseness gradually decreases in contrast thereto. When the angular contact position D of the elastic blade 167 increases up to an angle of about 90° or more, the degree of looseness is reduced within an acceptable range of about 10% or less. Hence, as shown in FIG. 5, according to this embodiment of the present invention, the angular contact position D of the elastic blade 167 is set to an angle of approximately 180°. However, according to this embodiment of the present invention, when the angular contact position D of the elastic blade 167 is located at the angle of about 90° or more, the degree of looseness is reduced within an acceptable range of about 10% as described above. That is, the angular contact position D of the elastic blade 167 is not limited to the angle of about 180°.

Now, the possible reason why the degree of looseness gradually decreases in contrast when an angle of the angular contact position D of the elastic blade 167 is increased from the angle of about 0° is herein below described. When the angular contact position D of the elastic blade 167 is located at the angle of about 0°, force applied to the cleaning web 165 to impede a movement thereof (i.e., the unwinding load thereof) when the winding roller 161 rotates and winds the cleaning web 165 thereon and accordingly the unwinding roller 162 unwinds the cleaning web 165 therefrom is constituted almost only by a friction generated in the contact section between the elastic blade 167 and the cleaning web. By contrast, however, when the angle of the angular contact position D of the elastic blade 167 is increased from the angle of about 0°, a friction between the cleaning web 165 (i.e., an outer layer) winding around the unwinding roller 162 from the angular contact position D to the unwinding angular position C and an inner cleaning web 165 (i.e., an inner first layer) that contacts an inner circumferential surface of the cleaning web 165 winding from the angular contact position D to the unwinding angular position C also constitutes the unwinding load as well in addition to the above-described friction of the contact section caused between the cleaning web 165 and the elastic blade 167. Further, as the angle of the angular contact position D of the elastic blade 167 is increased from the angle of about 0°, since a length of the cleaning web 165 extended from the angular contact position D to the unwinding angular unwinding position C increases, the friction caused between the cleaning web 165 winding from the angular contact position D to the unwinding angular position C and the inner cleaning web 165 accordingly increases in proportion thereto. Hence, because of such a configuration, it is considered that the degree of looseness gradually decreases as the angle of the angular contact position D of the elastic blade 167 is increased from the angle of about 0°.

However, since there is a limit to reduction of the degree of looseness of the cleaning web 165, the reduction of the degree of looseness does not increase any more when the unwinding load becomes a prescribed level or more. Hence, in the example as shown in FIGS. 5 and 6, the degree of looseness may almost stay at about 10% when the angular contact position of the elastic blade 167 is located at the angle of about 90° or more.

Here, since temperature of the elastic blade 167 easily increases when receiving transfer of heat from the fixing roller 141, the elastic blade 167 is desirably made of heat resistant material to be able to continuously apply a prescribed rotational load (i.e., the unwinding load) constantly.

Figure 7:
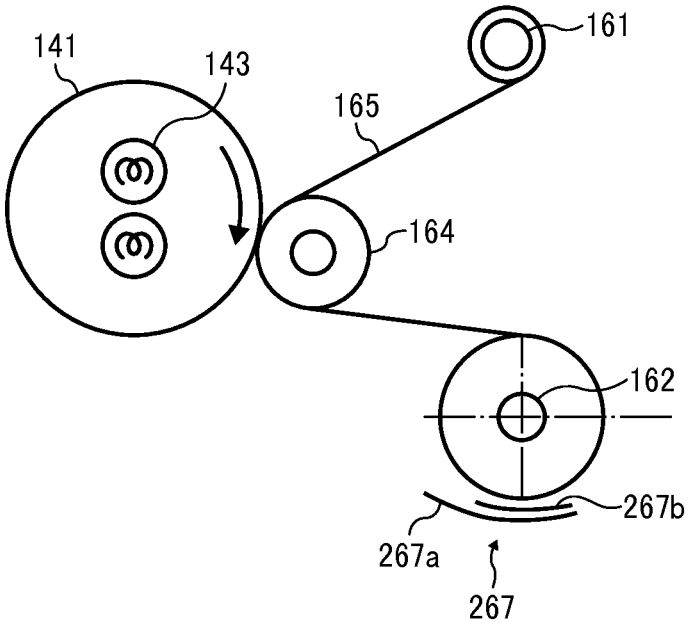
FIG. 7 is a diagram illustrating an exemplary multilayered elastic blade mainly composed of a base material and a contact section respectively made of different materials according to another embodiment of the present invention.

Further, although the elastic blade 167 is configured by a single member in the above-described various embodiments of the present invention, the present invention is not limited thereto. For example, as shown in FIG. 7, a multilayered (e.g., double-layered) elastic blade 267 may be utilized. The multilayered elastic blade 267 includes an elastic base material 267*a* that provides elastic force and a contact section 267*b* that contacts the cleaning web 165 winding around the unwinding roller 162. That is, when the elastic blade is configured by a single part, it is required to simultaneously exert both an elastic function to apply required pressure and a friction function to generate friction required between the cleaning web 165 and itself. However, such coexistence is generally difficult. By contrast, however, when the multilayered elastic blade 267 as shown in FIG. 7 is employed, the base material 267*a* can be made of material suitable for obtaining the elastic function, while preparing the contact section 267*b* by using material suitable for obtaining the friction function. More specifically, the base material 267*a* is desirably made of either elastic member or rigid member (i.e., a non-elastic member). The contact section 267*b* is desirably made of one of elastic material different from material of the base material 267*a*, resin, and high friction material or the like.

Figure 8:
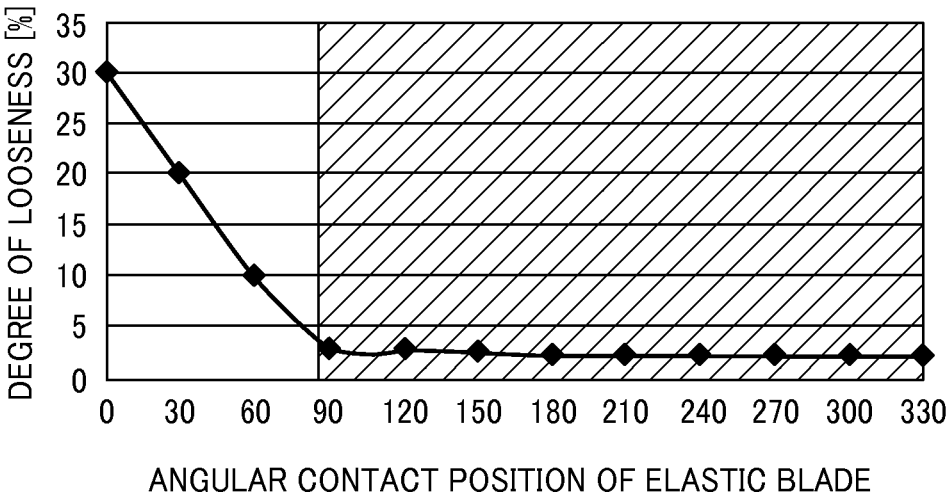
FIG. 8 is a chart illustrating an exemplary relation between the degree of looseness of the cleaning web and the angular contact position on the unwinding roller contacted by the multilayered elastic blade according to the other embodiment of the present invention.

FIG. 8 is a graph illustrating an exemplary relation between an angular contact position D of the multilayered elastic blade 267 and a degree of looseness of the cleaning web 165 when the multilayered elastic blade 267 is employed. As shown there, also in this example, as the angle of the angular contact position of the multilayered elastic blade 267 is increased from the angle of about 0°, the degree of looseness gradually decreases again. In particular, according to this example, by increasing the angle of the angular contact position of the multilayered elastic blade 267 to the angle of about 90° or more, the degree of looseness can be reduced within about 3% or less.

Hence, in the above-described various embodiments of the present invention, the outer circumferential surface of the fixing roller 141 is effectively cleaned by the web cleaning unit 16. However, an objective to be cleaned by the web cleaning unit 16 is not limited to the fixing roller 141, and the pressing roller 142 can be also cleaned by the web cleaning unit 16 as well, for example.

Hence, according to one aspect of the present invention, since a load applicator presses against a cleaning web unwound from a rotary unwinding member, an unwinding load can be directly applied to the unwound cleaning web, thereby obtaining a greater load. Further, since the load applicator of this aspect of the present invention presses against the cleaning web at an angular contact position D, up to which the cleaning web winds around the rotary unwinding member at a prescribed angle or more from an angular unwinding position C, from which the cleaning web is unwound from the rotary unwinding member, a friction generated between the cleaning web that winds therearound from the angular contact position D to the unwinding angular position C and an inner cleaning web that contacts an inner circumferential surface of the cleaning web that winds from the angular contact position D to the unwinding angular position C can also constitutes the unwinding load together with the friction generated in a contact section between the cleaning web and the elastic blade. Consequently, a greater unwind load can be obtained. Further, since a rotation driving force of a rotary winding member is set to a prescribed level capable of unwinding a cleaning web from the rotary unwinding member even if the above-described great unwinding load is applied to the cleaning web. As a result, even when a toner image is formed by using multiple toner particles having different optimum ranges of fixing conditions, respectively, and are fixed thereafter thereby producing a large amount of offset toner on an outer circumferential surface the rotary fixing member and increasing a friction force between the rotary fixing member and the cleaning web, the cleaning web is inhibited from separating from the rotary winding member.

That is, according to one aspect of the present invention, an image forming apparatus includes a toner image forming device to form a toner image on a recording medium by using multiple toner particles respectively having different optimum fixing conditions, a fixing device having a rotary fixing member and a pressing member to fix the toner image formed by the toner image forming device into the recording medium based on a given fixing condition while holding the recording medium bearing the toner image between the rotary fixing member and the pressing member thereon; and a rotary fixing member cleaner. The rotary fixing member cleaner includes a freely rotatable rotary unwinding member, around which a cleaning web winds, a rotary winding member that winds the cleaning web unwound from the freely rotatable rotary unwinding member thereon from one end thereof, and a load applicator that applies a load to the cleaning web unwound from the rotary unwinding member. The rotary fixing member cleaner removes any unnecessary substance adhering to an outer circumferential surface of the rotary fixing member therefrom by unwinding and moving the cleaning web from the rotary unwinding member in an opposite direction to a direction of movement of the outer circumferential surface of the rotary fixing member at a contacting point at which the cleaning web contacts the outer circumferential surface of the rotary fixing member. The load applicator applies the load to the cleaning web by pressing against the cleaning web winding around the rotary unwinding member at a prescribed angular contact position, up to which the cleaning web winds around the rotary unwinding member at a prescribed angle from an unwinding angular position at which the cleaning web is unwound from the rotary unwinding member.

According to another aspect of the present invention, the unwinding load can be directly applied more effectively to the unwound cleaning web, thereby obtaining a greater unwinding load while more effectively inhibiting the cleaning web from separating from the rotary winding member. That is, according to another aspect of the present invention, the rotary fixing member cleaner further includes a drive motor that drives and rotates the rotary winding member to wind the cleaning web thereon. Further, the freely rotatable rotary unwinding member is rotated by the rotary winding member via the cleaning web to unwind the cleaning web when the drive motor drives and rotates the rotary winding member.

According to yet another aspect of the present invention, the unwinding load can be directly applied more effectively to the unwound cleaning web, thereby obtaining a greater unwinding load while more effectively inhibiting the cleaning web from separating from the rotary winding member. That is, according to yet another aspect of the present invention, the rotary fixing member cleaner further includes a cleaning web pressing roller biased by a biasing member to press the cleaning web stretched between the rotary winding member and the freely rotatable rotary unwinding member therebetween against an outer circumferential surface of the rotary fixing member.

According to yet another aspect of the present invention, a prescribed amount of unwinding load can be applied to reduce a degree of looseness of the cleaning web within a prescribed acceptable range constantly. Hence, since the rotation driving force of the rotary winding member can be accordingly set to a greater level, the cleaning web can be more highly likely inhibited from separating from the rotary winding member. That is, according to yet another aspect of the present invention, the prescribed angle at which the cleaning web winds around the rotary unwinding member from an unwinding angular position, is set to about 90 degrees.

According to yet another aspect of the present invention, a prescribed amount of an unwinding load can be more effectively applied to the unwound cleaning web to effectively reduce the degree of looseness of the cleaning web within an acceptable range constantly, while more precisely inhibiting the cleaning web from separating from the rotary winding member. That is, according to yet another aspect of the present invention, the load applicator is a plate that applies the load to the cleaning web winding around the rotary unwinding member by bringing a free end edge of the plate having a round shape in contact with the cleaning web. The round shape of the free end edge of the plate is formed by applying a hemming bending process to the free end edge thereof.

According to yet another aspect of the present invention, the cleaning web is more unlikely damaged when compared with a system, in which one end (i.e., an edge) of a plate presses against the cleaning web. That is, according to yet another aspect of the present invention, the load applicator is a plate that applies the load to the cleaning web winding around the rotary unwinding member by bringing a surface of the plate in contact with the cleaning web via a prescribed contact area.

According to yet another aspect of the present invention, even when the cleaning web loosely wound around the rotary unwinding member, and thereby relaxing upstream of the contact section of the plate in the direction of rotation of the rotary unwinding member, a loosened portion of the cleaning web can avoid from being hooked to a free end (i.e., an edge) of the plate. At the same time, the cleaning web can avoid from unwinding error generally occurring when it is hooked. That is, according to yet another aspect of the present invention, the plate has elasticity and applies pressure to the cleaning web winding around the rotary unwinding member by contacting the cleaning web via a surface portion near a free end of the plate located downstream in a direction of rotation of the rotary unwinding member while securing a fixed end of the plate located upstream in the direction of rotation of the rotary unwinding member to a housing of the rotary fixing member cleaner.

According to yet another aspect of the present invention, although a large amount of toner is easily offset while causing great friction on an outer circumferential surface of the rotary fixing member, the cleaning web is inhibited from separating from the rotary winding member. That is, according to yet another aspect of the present invention, the multiple toner particles include a polymerized toner particle prepared by using a polymerization method and a grinded toner particle prepared by using a grinding method.

According to yet another aspect of the present invention, a rotary pressing member can be cleaned while inhibiting the cleaning web from separating from the rotary winding member. That is, according to yet another aspect of the present invention, the pressing member is a rotary pressing member driven by the rotary fixing member in a prescribed direction of rotation. The fixing member cleaner removes any unnecessary substance adhering to an outer circumferential surface of the rotary pressing member.

According to yet another aspect of the present invention, although it is generally difficult for an elastic blade constituted by a single part to simultaneously provide both an elastic function to apply required pressure and a friction function to generate required friction between the cleaning web and itself, the elastic function and the friction function can be readily obtained at the same time. That is, the elastic base material and the contact section are made of different materials, respectively, so that the base material 267*a* and the contact section 267*b* are made of materials suitable for obtaining the elastic function and the friction function, respectively.

According to yet another aspect of the present invention, although it is generally difficult for an elastic blade constituted by a single part to simultaneously provide both an elastic function to apply required pressure and a friction function to generate required friction between the cleaning web and itself, the elastic function and the friction function can be readily obtained at the same time. That is, the plate has a multi-layer including an elastic base material having elasticity and a contact section to contact the cleaning web winding around the rotary unwinding member.

According to yet another aspect of the present invention, a loosened portion of the cleaning web can effectively avoid from being hooked by the load applicator. That is, according to yet another aspect of the present invention, the load applicator applies pressure by bringing either a free end of a plate or a plate face near the free end of the plate in contact with the cleaning web winding around the rotary unwinding member while securing a fixed end of the plate to a housing of the rotary fixing member cleaner.

According to yet another aspect of the present invention, a prescribed amount of unwinding load can be continuously applied to reduce a degree of looseness of the cleaning web within a prescribed acceptable range constantly. That is, according to yet another aspect of the present invention, the elastic blade is made of heat resistant material.

Numerous additional modifications and variations of the present invention are possible in light of the above teachings. It is therefore to be understood that within the scope of the appended claims, the present invention may be executed otherwise than as specifically described herein. For example, the image forming apparatus is not limited to the above-described various embodiments and modifications and may be altered as appropriate. Also, the rotary fixing member cleaner is not limited to the above-described various embodiments and modifications and may be altered as appropriate. Further, the method of forming an image is not limited to the above-described various embodiments and may be altered as appropriate. For example, steps of the method of forming an image can be altered as appropriate.

What is claimed is:

1. An image forming apparatus comprising:

a toner image forming device to form multiple toner images on a recording medium by using multiple toner particles respectively having different optimum fixing conditions;

a fixing device having a rotary fixing member and a pressing member to fix the toner image formed by the toner image forming device into the recording medium based on a given fixing condition while holding the recording medium bearing the toner image thereon therebetween; and a rotary fixing member cleaner including;

a freely rotatable rotary unwinding member, around which a cleaning web winds, a rotary winding member to wind the cleaning web unwound from the freely rotatable rotary unwinding member thereon from one end thereof, and a load applicator to apply a load to the cleaning web unwound from the rotary unwinding member, the rotary fixing member cleaner removing any unnecessary substance adhering to an outer circumferential surface of the rotary fixing member therefrom by unwinding and moving the cleaning web from the rotary unwinding member in an opposite direction to a direction of movement of the outer circumferential surface of the rotary fixing member at a contacting point at which the cleaning web contacts the outer circumferential surface of the rotary fixing member, the load applicator applying the load to the cleaning web by pressing against the cleaning web winding around the rotary unwinding member at a prescribed angular contact position, up to which the cleaning web winds around the rotary unwinding member at a prescribed angle from an unwinding angular position at which the cleaning web is unwound from the rotary unwinding member.

2. The image forming apparatus as claimed in claim 1, wherein the recording medium bearing the toner image on a front surface thereof is conveyed between the rotary fixing member and the pressing member with the front surface thereof facing the rotary fixing member, wherein the unnecessary substance adhering to the outer circumferential surface of the rotary fixing member is toner in the toner image borne on the front surface of the recording medium offset thereto during a fixing process.

3. The image forming apparatus as claimed in claim 1, wherein the rotary fixing member cleaner further includes a drive motor to drive and rotate the rotary winding member to wind the cleaning web thereon, wherein the freely rotatable rotary unwinding member is rotated by the rotary winding member via the cleaning web to unwind the cleaning web therefrom when the drive motor drives and rotates the rotary winding member.

4. The image forming apparatus as claimed in claim 1, wherein the rotary fixing member cleaner further includes a cleaning web pressing roller biased by a biasing member to press the cleaning web stretched between the rotary winding member and the freely rotatable rotary unwinding member therebetween against an outer circumferential surface of the rotary fixing member.

5. The image forming apparatus as claimed in claim 1, wherein the prescribed angle is from about 90 degrees to about 330 degrees.

6. The image forming apparatus as claimed in claim 1, wherein the prescribed angle is about 90 degrees.

7. The image forming apparatus as claimed in claim 1, wherein the load applicator is a plate applying the load to the cleaning web winding around the rotary unwinding member by contacting the cleaning web via a prescribed contact surface area of the plate.

8. The image forming apparatus as claimed in claim 7, wherein the plate has elasticity and applies pressure to the cleaning web by contacting the cleaning web winding around the rotary unwinding member via the surface of the plate near a free end of the plate located downstream in a direction of rotation of the rotary unwinding member while securing a fixed end of the plate located upstream in the direction of rotation of the rotary unwinding member to a housing of the rotary fixing member cleaner.

9. The image forming apparatus as claimed in claim 1, wherein the load applicator is a plate applying the load to the cleaning web winding around the rotary unwinding member by contacting the cleaning web via a free end edge of the plate, wherein the free end edge of the plate has a round shape.

10. The image forming apparatus as claimed in claim 9, wherein the plate has elasticity and applies pressure to the cleaning web by contacting the cleaning web winding around the rotary unwinding member via the free end edge of the plate located upstream in a direction of rotation of the rotary unwinding member while securing a fixed end of the plate located downstream in the direction of rotation of the rotary unwinding member to a housing of the rotary fixing member cleaner.

11. The image forming apparatus as claimed in claim 1, wherein the multiple toner particles include a polymerized toner particle prepared by using a polymerization method and a grinded toner particle prepared by using a grinding method.

12. The image forming apparatus as claimed in claim 1, wherein the multiple toner particles include a special color toner particle to form a special color toner image and an ordinary color toner particle to form an ordinary color toner image.

13. The image forming apparatus as claimed in claim 12, wherein a special color of the special color toner particle is transparent or white in color, wherein the ordinary color toner particle is at least one of yellow, magenta, cyan, and black colors.

14. The image forming apparatus as claimed in claim 1, wherein the pressing member is a rotary pressing member driven by the rotary fixing member in a prescribed direction of rotation, wherein the fixing member cleaner removes any unnecessary substance adhering to an outer circumferential surface of the rotary pressing member.

15. The image forming apparatus as claimed in claim 1, wherein the load applicator applies pressure to the cleaning web winding around the rotary unwinding member by contacting the cleaning web via either a free end of a plate or a plate face near the free end of the plate while securing a fixed end of the plate to a housing of the rotary fixing member cleaner, wherein the plate has a multi-layer including an elastic base material having elasticity and a contact section to contact the cleaning web winding around the rotary unwinding member, wherein the elastic base material and the contact section are made of different materials, respectively.

16. The image forming apparatus as claimed in claim 15, wherein the elastic base material is made of elastic material and the contact section is made of material having a friction function.

17. The image forming apparatus as claimed in claim 1, wherein the load applicator applies pressure to the cleaning web winding around the rotary unwinding member by contacting the cleaning web via either a free end of a plate or a plate face near the free end of the plate while securing a fixed end of the plate to a housing of the rotary fixing member cleaner, wherein the plate is an elastic blade made of heat resistant material.

18. A cleaner for a rotary fixing member comprising:

a freely rotatable rotary unwinding member, around which a cleaning web winds;

a rotary winding member to wind the cleaning web unwound from the freely rotatable rotary unwinding member thereon from one end of the cleaning web, the rotary winding member rotating the freely rotatable rotary unwinding member by winding the cleaning web thereon to unwind the cleaning web therefrom when driven and rotated;

a drive motor to drive and rotate the rotary winding member to wind the cleaning web thereon, a cleaning web pressing roller biased by a biasing member to press the cleaning web stretched between the rotary winding member and the freely rotatable rotary unwinding member therebetween against the outer circumferential surface of the rotary fixing member; and a load applicator to apply a load to the cleaning web unwound from the rotary unwinding member, the rotary fixing member cleaner removing any unnecessary substance adhering to an outer circumferential surface of the rotary fixing member therefrom by unwinding and moving the cleaning web from the rotary unwinding member in an opposite direction to a direction of movement of an outer circumferential surface of the rotary fixing member at a contacting point at which the cleaning web contacts the outer circumferential surface of the rotary fixing member, the load applicator applying the load to the cleaning web winding around the rotary unwinding member by pressing against the cleaning web at a prescribed angular contact position, up to which the cleaning web winds around the rotary unwinding member at a prescribed angle from an unwinding angular position at which the cleaning web is unwound from the rotary unwinding member.

19. A method of forming an image, comprising the steps of:

forming a toner image on a recording medium by using a toner image forming device with multiple toner particles respectively having different optimum fixing conditions;

fixing the toner image formed by the toner image forming device into the recording medium based on a given fixing condition by using a fixing device having a rotary fixing member and a pressing member while holding the recording medium bearing the toner image thereon between the rotary fixing member and the pressing member; and cleaning an outer circumferential surface of the rotary fixing member by using a rotary fixing member cleaner including a freely rotatable rotary unwinding member, around which a cleaning web winds, a rotary winding member that rotates and winds the cleaning web unwound from the freely rotatable rotary unwinding member thereon from one end thereof, and a load applicator that applies a load to the cleaning web unwound from the rotary unwinding member, the step of cleaning the outer circumferential surface of the rotary fixing member including the sub-steps of:

applying the load to the cleaning web winding around the rotary unwinding member by pressing the load applicator against the cleaning web at a prescribed angular contact position, up to which the cleaning web winds around the rotary unwinding member at a prescribed angle from an unwinding angular position at which the cleaning web is unwound from the rotary unwinding member, unwinding and moving the cleaning web from the rotary unwinding member in an opposite direction to a direction of movement of an outer circumferential surface of the rotary fixing member at a contacting point at which the cleaning web contacts the outer circumferential surface of the rotary fixing member, and removing any unnecessary substance adhering to an outer circumferential surface of the rotary fixing member therefrom.

* * * * *